US005479847A

United States Patent [19]

Powers et al.

[11] Patent Number: 5,479,847

[45] Date of Patent: Jan. 2, 1996

[54] DUAL-PISTON PUMP APPARATUS

[75] Inventors: Richard G. Powers; William R. Wright, both of Overland Park, Kans.

[73] Assignee: Marlen Research Corporation, Overland Park, Kans.

[21] Appl. No.: 335,139

[22] Filed: Nov. 7, 1994

[51] Int. Cl.[6] ..... F01B 31/00

[52] U.S. Cl. ..... 92/87; 92/128; 92/146; 92/161; 92/255; 417/515; 222/255; 222/275

[58] Field of Search ..... 92/146, 117 R, 92/161, 87, 128, 255; 417/515, 510; 222/255, 278, 275, 236

[56] References Cited

U.S. PATENT DOCUMENTS

| | | | |
|---|---|---|---|
| 158,729 | 1/1875 | Neumeyer | 222/255 |
| 1,181,837 | 5/1916 | Campbell | 222/255 |
| 2,408,346 | 9/1946 | Smith | 92/128 |
| 4,588,110 | 5/1986 | Nelson et al. | 222/275 |
| 4,869,653 | 9/1989 | Powers et al. . | |
| 5,396,831 | 3/1995 | Marvin et al. | 92/128 |

FOREIGN PATENT DOCUMENTS

| | | | |
|---|---|---|---|
| 3311573 | 6/1984 | Germany | 417/510 |

*Primary Examiner*—Thomas E. Denion

*Attorney, Agent, or Firm*—Hovey, Williams, Timmons & Collins

[57] ABSTRACT

A dual-piston pump apparatus includes a pair of reciprocating sleeves within which a pair of reciprocating pistons are disposed. The pistons and sleeves are each supported on a frame for independent reciprocating movement along a line angled relative to horizontal by an angle of less than about 60°. The apparatus also includes a piston construction including a removable face which permits the piston to be broken down for cleaning. Each piston is normally restricted by a stop from extension beyond the end of the corresponding sleeve, but an actuator is provided for freeing the piston relative to the sleeve so that the piston may be extended beyond the sleeve and the sleeve may be withdrawn from a pump chamber of the apparatus.

20 Claims, 9 Drawing Sheets

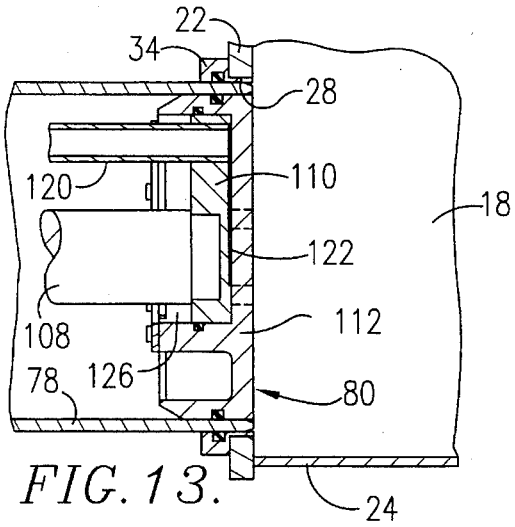
FIG. 13.
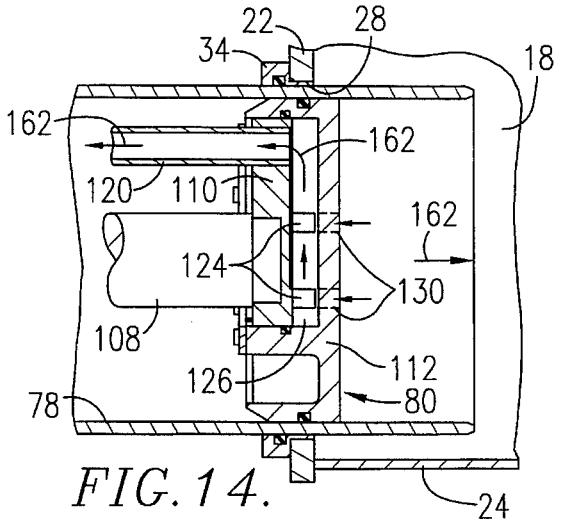
FIG. 14.
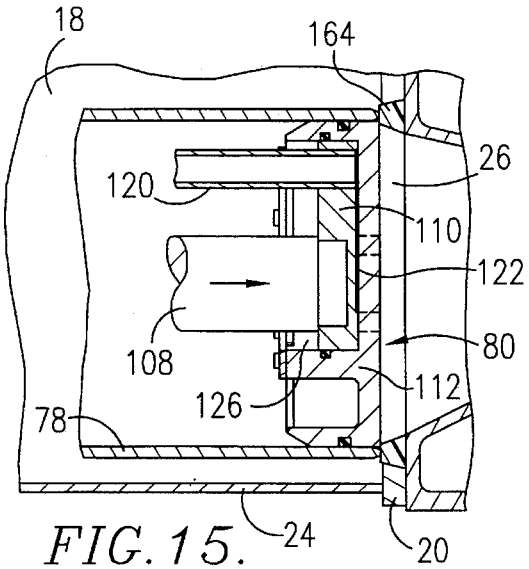
FIG. 15.
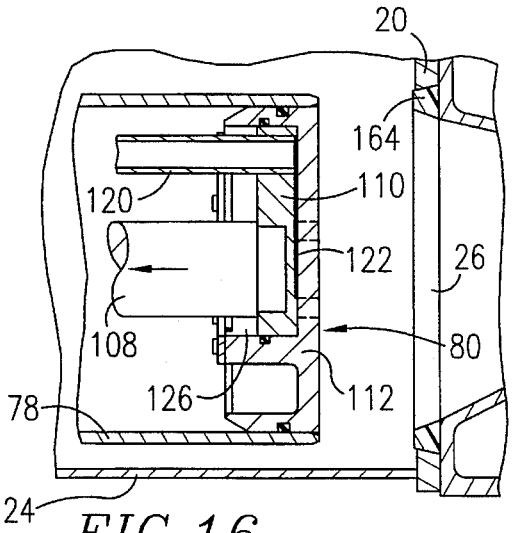
FIG. 16.
FIG. 10.
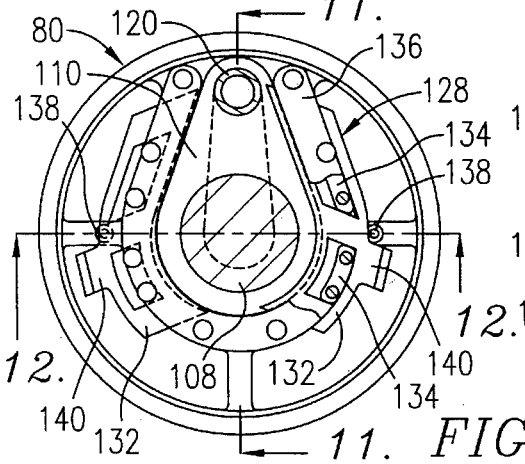
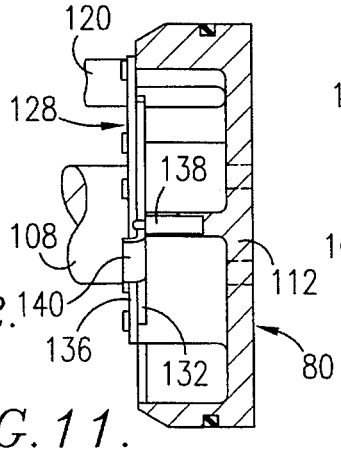
FIG. 11.
FIG. 12.
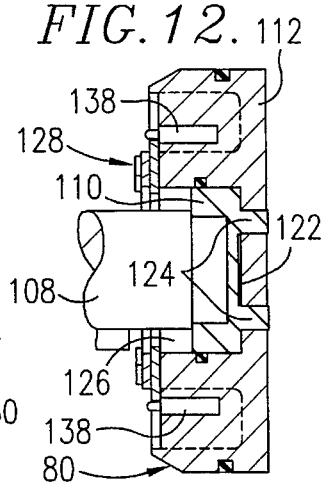

DUAL-PISTON PUMP APPARATUS

BACKGROUND OF THE INVENTION

1. Field of the Invention

The present invention relates generally to material handling equipment and, more particularly, to a dual-piston pump or the like presenting an angled pump chamber and piston arrangement for assisting in operation and clean-up of the apparatus, and including a construction that permits the components of the apparatus to be easily broken down for cleaning.

2. Discussion of the Prior Art

Food processors often make use of large pumps for pumping and/or portioning of comestible products such as meat or vegetables. One class of food pump of this character which has achieved substantial commercial success is the twin piston food pumps commercialized by Marlen Research Corporation of Overland Park, Kans. Exemplary pumps of this type are illustrated in U.S. Pat. No. 4,869,653 which is incorporated by reference herein.

Generally, a conventional pump includes a pair of side-by-side assemblies supported on a frame in communication with a pump chamber to which comestible products are supplied. The pump chamber is defined by a front wall, a rear wall, and a side wall extending therebetween. Each assembly includes a sleeve that is movable in a horizontal direction through the chamber between a retracted position in which an end of the sleeve is moved to within one or two inches of the rear wall of the chamber, and an extended position in which the end of the sleeve engages the front wall. A piston is also provided for each assembly, and is supported within the sleeve for independent reciprocating movement relative to both the sleeve and the pump chamber.

Because the sleeves and pistons in the conventional construction are supported for reciprocating movement in a horizontal plane, and the pump chamber is shaped to accommodate this movement, it is difficult to obtain complete drainage of cleaning fluid from the apparatus during a clean-up operation. Rather, cleaning fluid introduced into the chamber and sleeves settles along the bottom thereof, preventing complete cleaning of these surfaces.

Another known construction for a pump apparatus includes a vertical sleeve and a piston supported in the sleeve for reciprocating movement. In this known construction, the piston is provided with a face that is angled relative to vertical such that no flat horizontal surfaces are provided on which the cleaning fluid may settle. However, comestible product is allowed to stick to the top of the piston during the entire pumping operation, and may become stale if the apparatus is not cleaned frequently enough.

In order to permit cleaning of the pistons of a conventional pump, it is known to provide a piston assembly including a removable face. A snap ring or other fastener is provided to hold the face in place on the piston during normal operation, and may be removed to permit removal of the face. However, such fasteners represent additional parts that must be separately cleaned, and are susceptible to being lost.

Another aspect of known dual-piston pumps resides in the provision of a construction in which the pistons are physically prevented from being extended beyond the ends of the sleeves, either during operation or clean up. This design insures that the piston will not pass completely through the sleeve and allow product in the pump chamber to blow back through the sleeve. However, this feature of the known design renders clean-up of the pistons and sleeves difficult, and restricts access to these parts of the apparatus.

OBJECTS AND SUMMARY OF THE INVENTION

It is an object of the present invention to provide a dual-piston pump apparatus that may be broken down into relatively few parts for cleaning, and that provides ready access to all surfaces in and around the pump chamber, sleeves and pistons.

It is another object of the present invention to provide an apparatus that allows cleaning fluid to drain thoroughly from the pump chamber, sleeves and pistons during clean-up, and that prevents comestible product from sticking to the pistons during a pumping operation.

A further object of the present invention is to provide an apparatus having pistons provided with removable faces that are retained on the pistons by attachment mechanisms that remain mounted on the faces. By providing this construction, all parts of the attachment mechanisms remain fixed to the faces, and no loose parts are required which might be easily lost.

Yet another object of the invention is to provide an apparatus in which comestible product is mixed in a hopper and intermittently conveyed to the pump chamber for handling.

In accordance with these and other objects evident from the following description of a preferred embodiment, a dual-piston pump is provided which includes a frame, a pair of side-by-side sleeves supported for reciprocating movement relative to the frame, and a pair of pistons received in the sleeves for independent reciprocating movement.

The frame includes a pump chamber having a front wall defining an outlet, a rear wall opposing the front wall, and an open top wall through which comestible material is supplied to the chamber. Each sleeve presents a free end, and is supported on the frame for reciprocating movement within the pump chamber between a retracted position in which the end of the sleeve is disposed adjacent the rear wall of the chamber and an extended position in which the end is disposed adjacent the outlet. Each piston presents a piston face, and is supported within one of the sleeves for reciprocating movement between a retracted position in which the piston face is disposed adjacent the rear wall of the chamber and an extended position in which the piston face is disposed adjacent the outlet.

In accordance with one aspect of the invention, a stop means is provided for physically preventing the ends of the sleeves from being withdrawn from the chamber beyond the rear end wall and the pistons from being extended beyond the ends of the sleeves. A release means is also provided for releasing the stop means to permit the sleeves to be withdrawn from the chamber and the pistons to be extended beyond the ends of the sleeves so that the chamber, sleeves and pistons are accessible for cleaning. By providing this construction, the piston is readily accessible for breakdown and/or cleaning, and it is possible to clean all surfaces that normally come into contact with the comestible product during a pumping operation.

In accordance with another aspect of the invention, the pistons are each supported on the frame for reciprocating movement within the pump chamber along a line that is angled relative to horizontal by an angle of less than about 45°, and preferably by an angle of about 11°. By constructing the apparatus in this manner, cleaning fluid drains from all areas of the pump chamber, the sleeves and the pistons without settling. At the same time, the orientation of the piston prevents the comestible product from sticking to the piston face during pumping.

Yet another aspect of the invention relates to the use of a piston construction including an elongated cylindrical rod presenting opposed first and second ends, a head secured to the first end of the rod and including a circumferential edge protruding radially beyond the rod, and a face presenting opposed front and rear surfaces, the face having a recess formed in the rear surface sized for receipt of the head. An attachment means is provided for attaching the face of each piston to the head of the piston and for permitting removal of the face from the head to permit cleaning of the face, head and rod of each piston. The attachment means includes a latch supported on the rear surface of each face and movable between a locking position overlying a portion of the recess and an unlocking position radially spaced from the recess, and a retaining means for retaining the latch in the locking position when the pistons are being reciprocated in use of the dual-piston pump apparatus and for releasing the latch for movement to the unlocking position during clean-up of the apparatus.

BRIEF DESCRIPTION OF THE DRAWINGS FIGURES

The preferred embodiment is described in detail below with reference to the attached drawing figures, wherein:

FIG. 10 is an end cross-sectional view of one of the pistons;

FIG. 11 is a sectional view taken along line 11—11 of FIG. 10;

FIG. 12 is a sectional view taken along line 12—12 of FIG. 10;

FIG. 13 is a side sectional view of a single sleeve and piston assembly, illustrating the sleeve and piston in retracted positions;

FIG. 14 is a side sectional view of the sleeve and piston, illustrating the sleeve during movement to an extended position;

FIG. 15 is a side sectional view of the sleeve and piston, illustrating the sleeve and piston in extended positions;

FIG. 16 is a side sectional view of the sleeve and piston, illustrating the sleeve and piston during movement toward the retracted positions;

DETAILED DESCRIPTION OF THE PREFERRED EMBODIMENT

Figure 1:
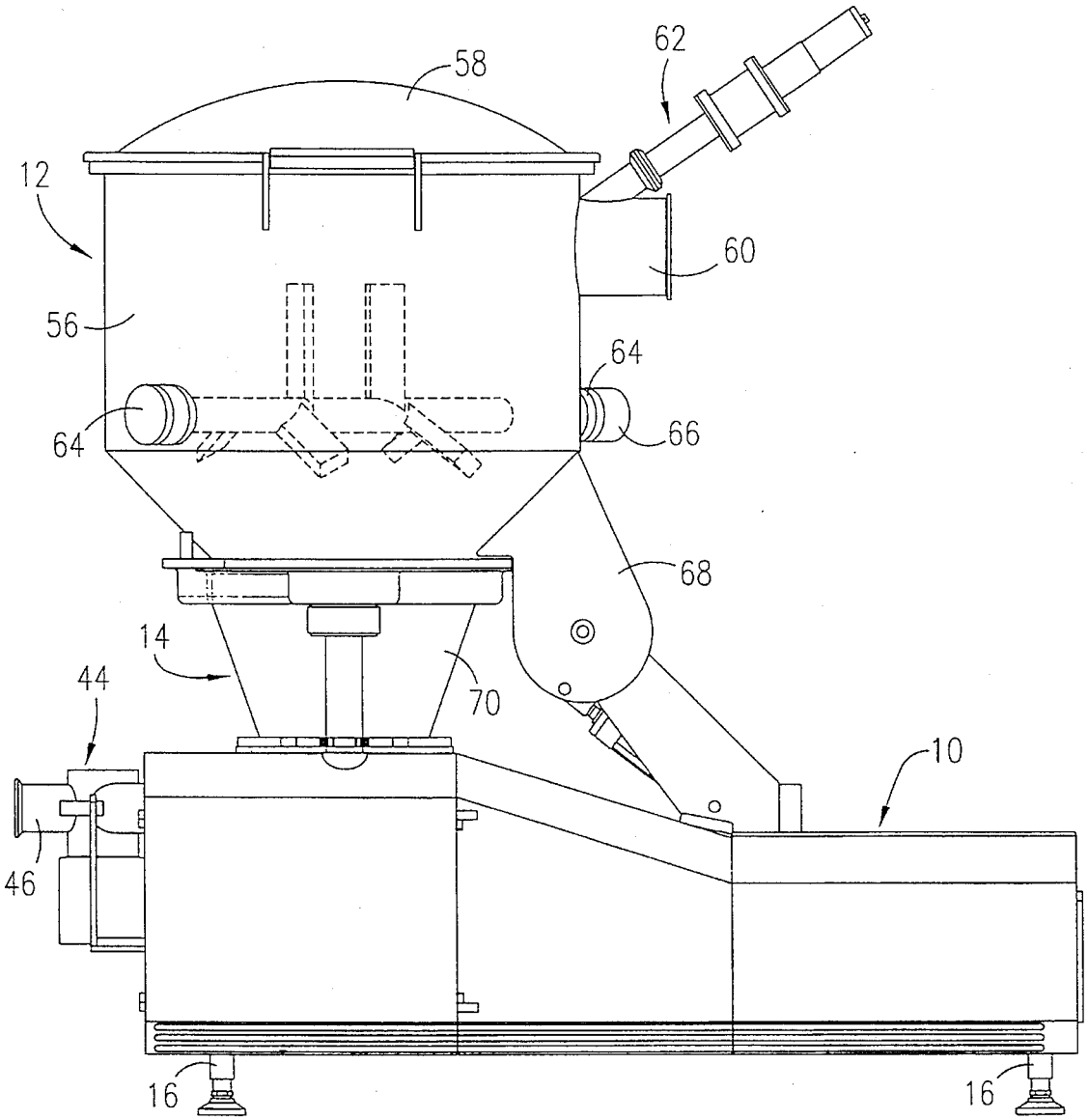
FIG. 1 is a side elevational view of a dual-piston pump apparatus constructed in accordance with the preferred embodiment.

A dual-piston pump apparatus constructed in accordance with the preferred embodiment is shown in FIG. 1. The apparatus generally includes a frame 10, a dual-piston pump housed within the frame, a hopper assembly 12 supported on the frame over the pump, and a transfer assembly 14 provided between the hopper and the pump.

Figure 2:
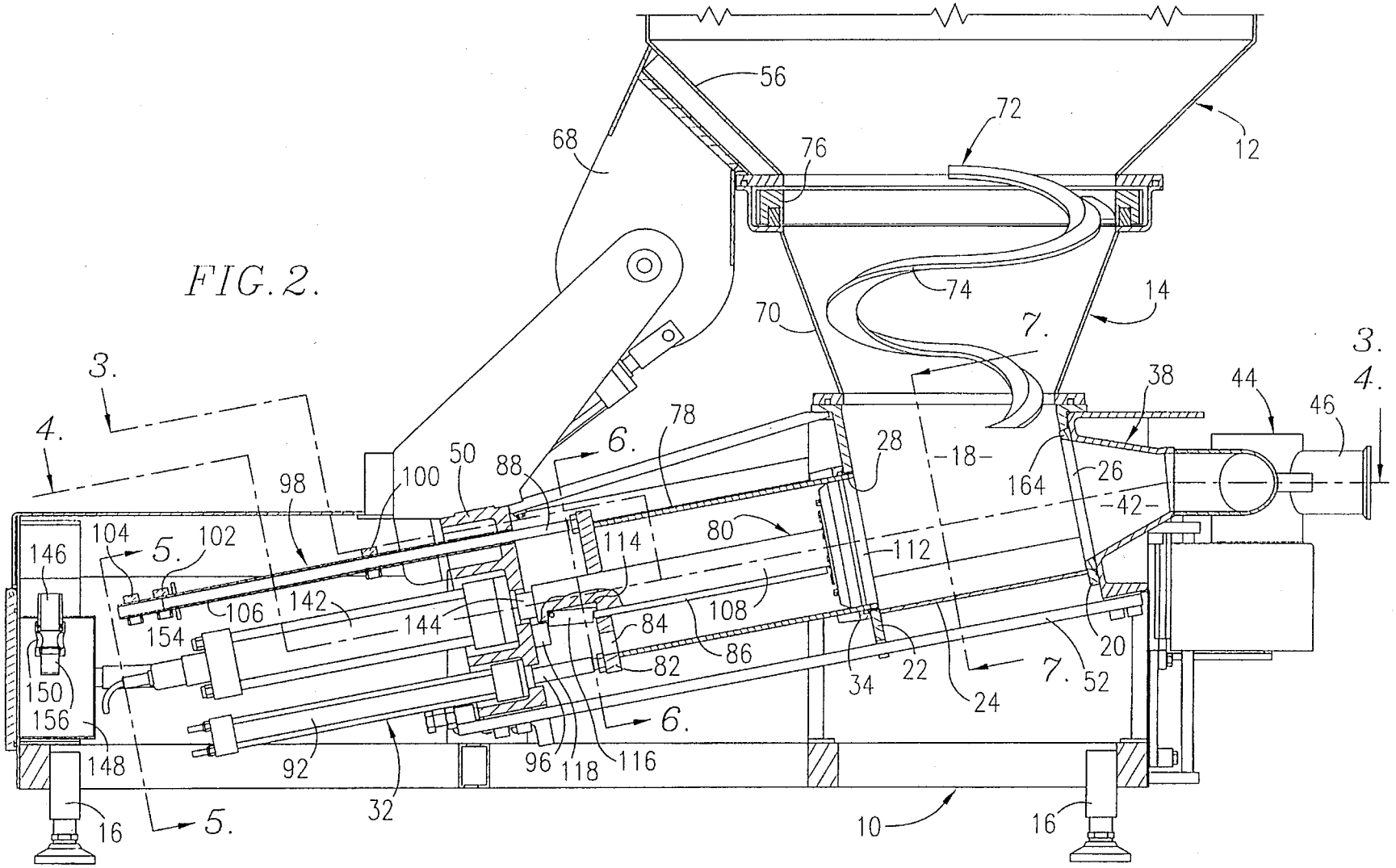
FIG. 2 is a fragmentary side elevation sectional view of the apparatus.
Figure 3:
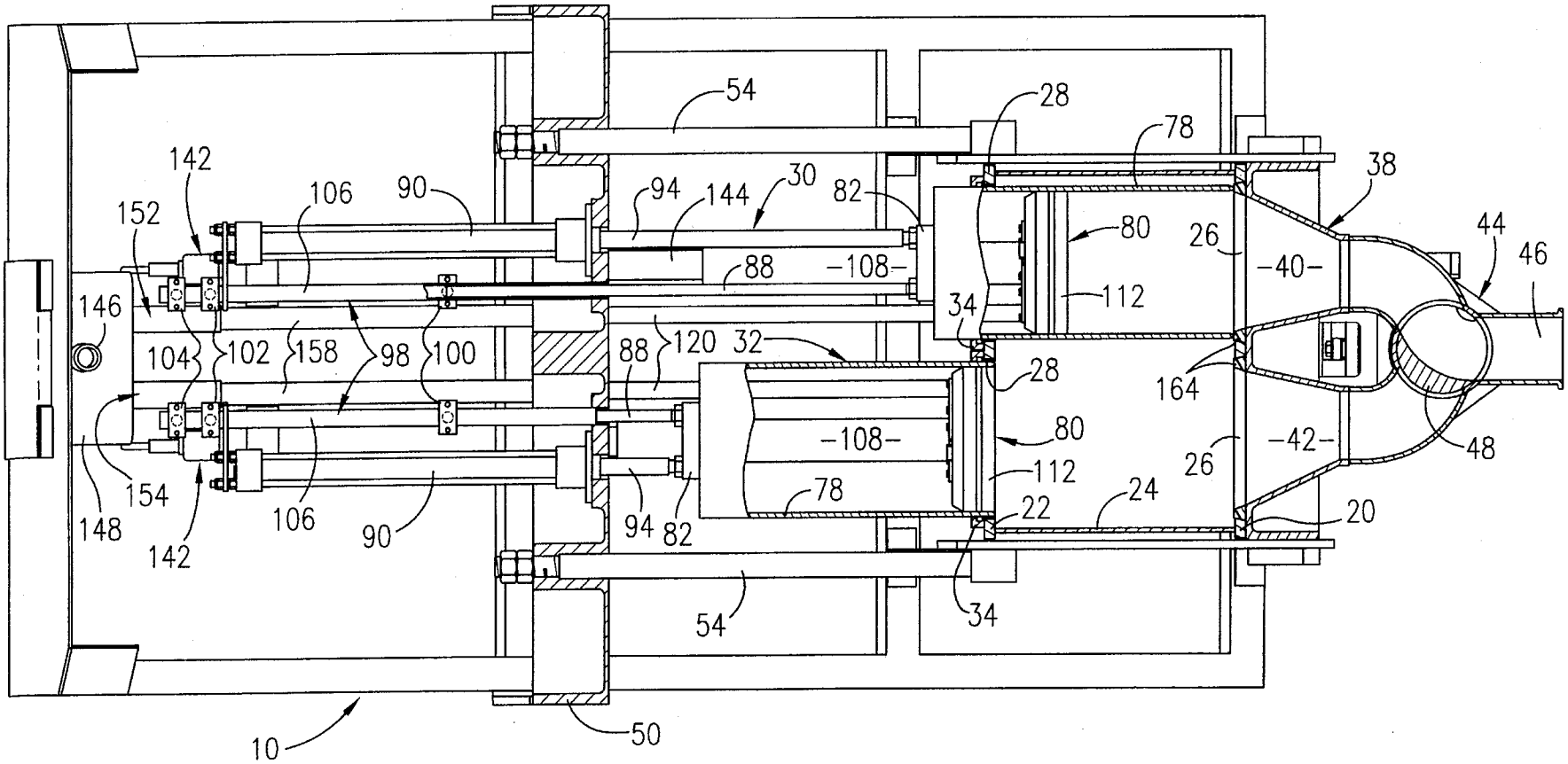
FIG. 3 is a sectional view taken along line 3—3 of FIG. 2, illustrating a pair of sleeves and pistons in a first operative position.

The frame 10 is illustrated in FIG. 2, and includes four or more upstanding legs 16 on which several horizontally and vertically extending frame members are mounted. The frame defines a pump chamber 18 that is in fluid communication with a pair of side-by-side piston pump assemblies, as shown in FIG. 3. The pump chamber is formed by opposing front and rear walls 20, 22 which are spaced from one another, and a generally U-shaped side wall 24, shown in FIG. 7, which forms the sides and bottom of the pump chamber.

The front wall 20 of the chamber is shown in FIG. 2, and includes a pair of side-by-side openings 26 that define outlets of the chamber. The rear wall 22 also includes a pair of side-by-side openings 28, and these openings receive the piston pump assemblies so that they may reciprocate back and forth within the chamber to pump comestible product through the outlet openings 26 and from the apparatus. Both the front and rear walls 20, 22 are angled relative to vertical by about 11°, and the side wall 24 is constructed to present an angled bottom of the chamber that extends in a direction perpendicular to the front and rear walls. Thus, the chamber is oriented at an angle to the frame so that when the frame is supported on a horizontally extending floor, the chamber is angled upward toward the outlet by an angle of about 11°.

Figure 6:
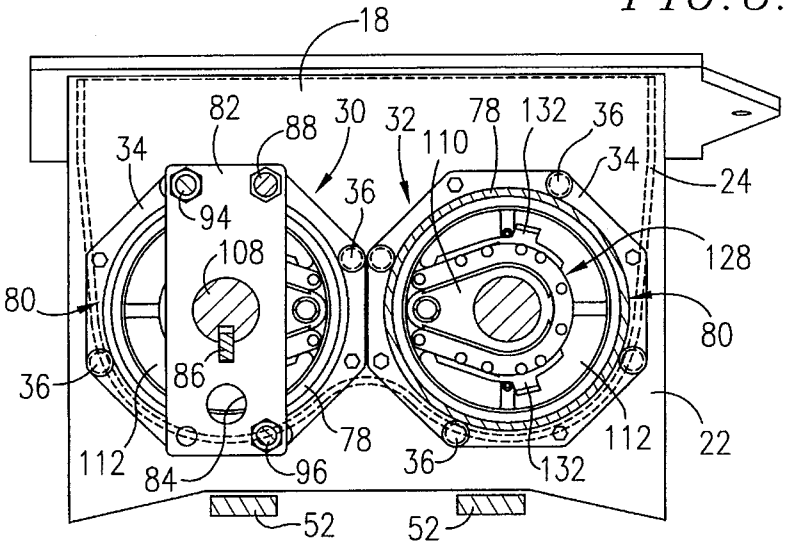
FIG. 6 is a sectional view taken along line 6—6 of FIG. 2.

A collar 34 is provided around each opening 28 in the rear wall, and receives a seal for sealing the space between the collar and the sleeve of each piston pump assembly. As shown in FIG. 6, the collars are retained on the rear wall by threaded fasteners, and include a plurality of protruding guide elements 36.

Figure 4:
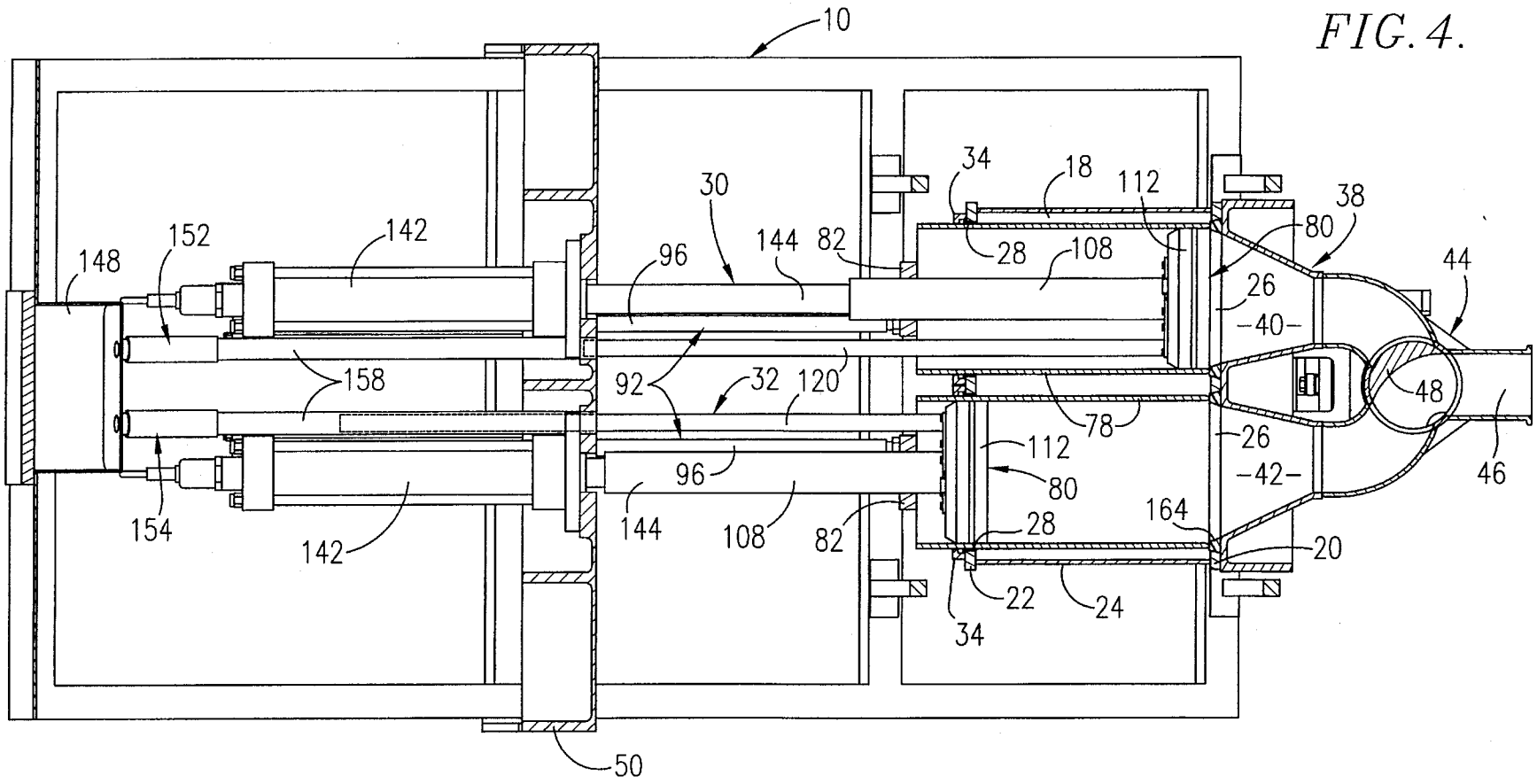
FIG. 4 is a sectional view taken along line 4—4 of FIG. 2, illustrating the sleeves and pistons in a second operative position.

As illustrated in FIG. 3, an outlet assembly 38 is supported on the frame forward of the front wall of the chamber, and includes a pair of outlet passages 40, 42 in communication with the openings 26. These passages intersect within an outlet valve assembly 44, and are alternately brought into fluid communication with an outlet 46 by a valve rotor 48 that rotates between a position as shown in FIG. 3 and a position as shown in FIG. 4. The valve rotor blocks each passage 40, 42 while the other passage is brought into communication with the outlet 46.

A mounting plate 50 is supported on the frame to the rear of the pump chamber, and is angled to the same degree as the front and rear walls of the chamber, as shown in FIG. 2. The mounting plate supports the two piston pump assemblies on the frame in alignment with the pump chamber, and guides reciprocating movement of the sleeves and pistons of the assemblies. The mounting plate is supported on the frame relative to the pump chamber by a first pair of tie rods 52 connected between the plate and the outlet assembly, and by a second pair of tie rods 54 connected between the upper end of the mounting plate and the frame, as shown in FIG. 3.

The hopper assembly is illustrated in FIG. 1, and includes a large cylindrical vacuumizer housing 56 having an open top and a tapered lower end narrowing to a discharge opening at the bottom of the housing. The housing 56 is hollow, and is adapted to receive and store the comestible product that is to be handled by the pump. A lid 58 is supported over the open top of the housing, and is pivotal between a closed, sealed position and an open position exposing the interior of the housing.

An inlet 60 is formed in the housing adjacent the upper end thereof, and is adapted to receive product from a supply source. The inlet includes a closure valve for closing off the inlet when desired, and a fluid-actuated cylinder assembly 62 is provided for opening and closing the valve. A mixer shaft extends across the interior of the housing and is supported for rotation by a pair of bearing assemblies 64 protruding from the housing. A hydraulic motor 66 or the like is mounted on the housing, and is operable to rotate the mixer shaft continuously during use. The mixer shaft is provided with a plurality of paddles or veins that rotate with the shaft to mix the product within the housing.

A pair of ears 68 are attached to the housing, and extend downward toward the frame. These ears are connected to an upstanding support of the frame for pivotal movement so that the hopper assembly may be pivoted between the position shown in FIG. 1, and a cleaning position generally perpendicular thereto.

The transfer assembly 14 is shown in FIG. 2, and includes a hollow tapered housing 70 having an open upper end of a size corresponding to the discharge opening of the hopper assembly, and an open lower end in fluid communication with the pump chamber. An auger assembly 72 is provided within the housing for moving material from the hopper into the pump chamber. The auger assembly includes a tapered spiral auger 74 having an upper end protruding above the transfer assembly into the discharge opening of the hopper assembly, and a lower end protruding through the open lower end of the transfer assembly into the pump chamber. The auger is secured to a ring gear 76 that is intermittently driven by a suitable motor and gear assembly in timed relation to reciprocation of the piston pump assemblies to turn the auger within the housing.

As illustrated in FIG. 3, the two piston pump assemblies 30, 32 are positioned side by side on the frame, and are supported by the mounting plate 50. Only one of the assemblies is described in detail herein, it being understood that the two assemblies are substantially identical to one another.

Each piston pump assembly broadly includes a sleeve 78, a means for reciprocating the sleeve back and forth through the pump chamber, a piston 80, and a means for reciprocating the piston back and forth through the pump chamber within the sleeve. A vacuum system is also provided in association with the piston pump assembly, and a control system coordinates operation of the two piston pump assemblies so that they operate in unison to sequentially pump material from the chamber through each of the outlet passages.

The sleeve 78 is of an elongated, hollow tubular construction presenting front and rear axial ends and an internal surface adapted to receive the piston in sealing engagement. As shown on the left-hand assembly 30 in FIG. 6, an end plate 82 is secured to the rear end of the sleeve for movement with the sleeve, and includes a drain hole 84 at the lowermost end of the sleeve to permit cleaning fluid to drain from the sleeve during cleaning. The end plate also includes a central, circular opening adapted to receive the piston, and the opening includes a small radially extending cutout for receiving a key 86 provided on the piston.

Additional holes are provided in at least three corners of the end plate, two of which permit connection of the plate to rods 94, 96 of the sleeve reciprocating means, and one of which is connected to a gauge rod 88, described more fully below.

Figure 5:
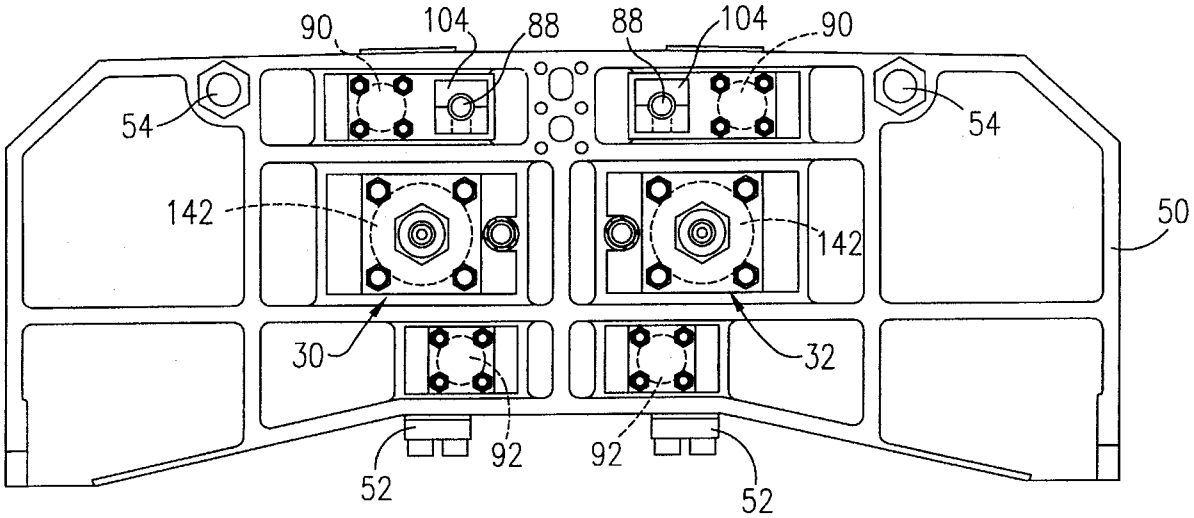
FIG. 5 is a sectional view taken along line 5—5 of FIG. 2.

Turning to FIG. 2, the sleeve reciprocating means preferably includes a pair of fluid-actuated cylinder assemblies 90, 92 connected to diametrically opposed corners of the end plate. As shown in FIG. 5, the cylinder assemblies are secured to the mounting plate 50, and support the sleeve during reciprocating movement relative to the frame. Returning to FIG. 2, wherein only the lower cylinder assembly 92 is shown, the sleeve reciprocating means is oriented at an angle to the frame so that actuation of the cylinder assemblies reciprocates the sleeve along a line that is angled by about 11° relative to horizontal. Each cylinder includes a rod 94, 96 protruding through the mounting plate and connected to the end plate, as shown in FIG. 6, so that as the cylinder assembly is actuated, the rod extends or retracts relative to the cylinder to move the sleeve.

Returning to FIG. 2, a position sensing assembly 98 is mounted on the frame adjacent the upper cylinder assembly, and functions to sense the position of the sleeve 78. The sensing assembly includes the gauge rod 88 which is connected to the end plate 82 of the sleeve, and three transducers or sensors 100, 102,104 supported at fixed locations on the frame.

The gauge rod 88 is an elongated rod formed of a material capable of being detected by the sensors, and is received in a non-magnetic sleeve 106 that is supported with the cylinder assembly on the mounting plate, as shown in FIG. 3. The three sensors 100, 102, 104 are supported on the sleeve, and each sensor senses the passage of the end of the gauge rod as the sleeve is reciprocated back and forth within the pump chamber.

Preferably, the forward sensor 100 is positioned on the sleeve to detect the end of the gauge rod when the sleeve 78 is in the fully extended position, and the middle sensor 102 is positioned to detect the end of the rod when the sleeve 78 is in the fully retracted position. The rearmost sensor 104 is positioned to sense the end of the rod 88 when the sleeve 78 is withdrawn from the chamber 18 for cleaning. The signals generated by the sensors are used to control actuation of the cylinder assemblies so that operation of the two piston pump assemblies is coordinated.

Figure 9:
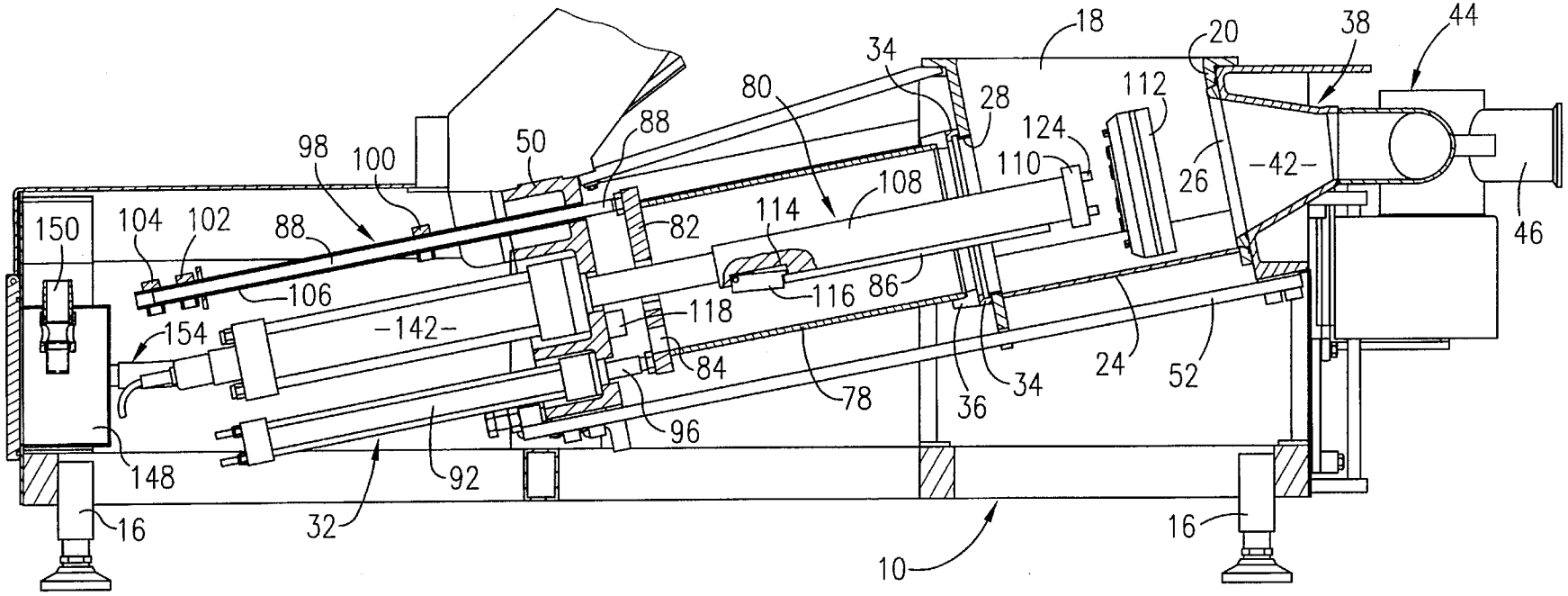
FIG. 9 is a fragmentary side elevation sectional view similar to FIG. 8, illustrating the pistons in an extended clean-up position.

A first embodiment of the piston 80 is illustrated in FIG. 9, and includes an elongated cylindrical rod 108 presenting opposed first and second ends, a head 110 secured to the first end of the rod and including a circumferential edge protruding radially beyond the rod, and a face 112 presenting opposed front and rear surfaces.

Figure 8:
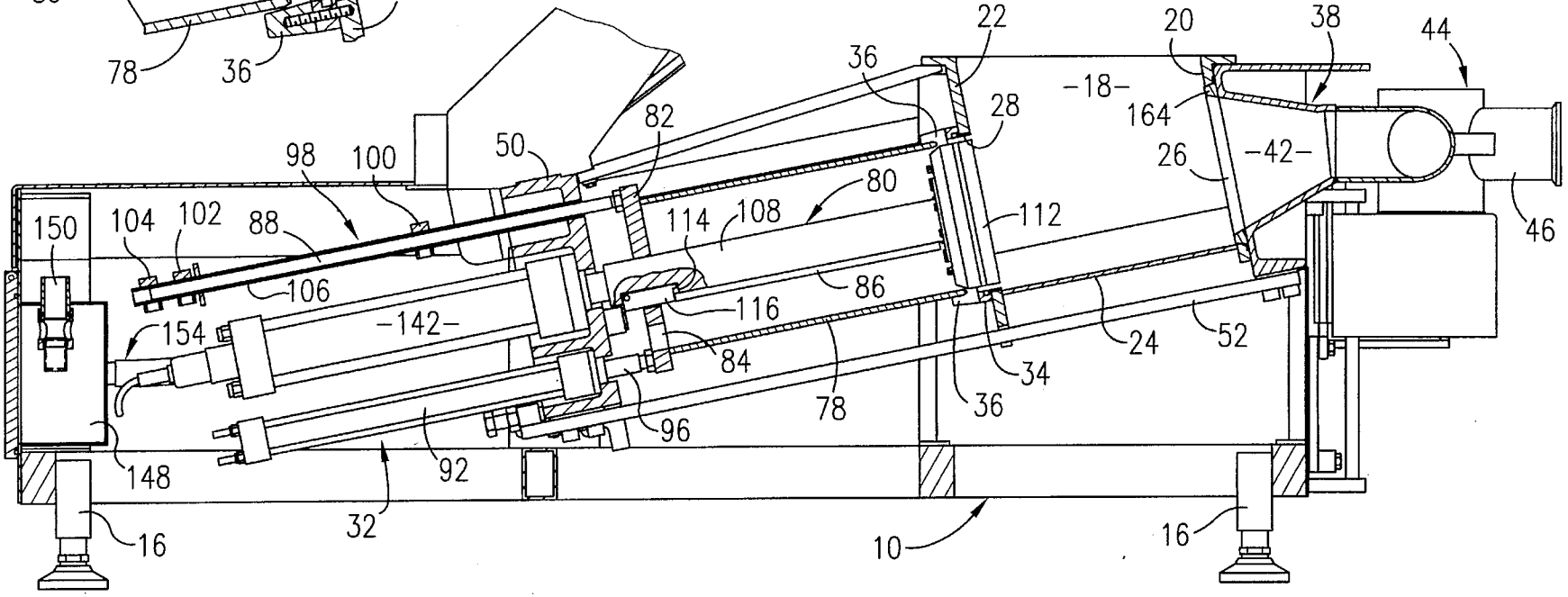
FIG. 8 is a fragmentary side elevation sectional view similar to FIG. 2, illustrating the sleeves in a retracted clean-up position.

The rod is preferably formed of a solid, cylindrical piece of material, and includes an axially extending slot within which the key 86 is secured. A recess 114 extends radially into the rod adjacent the rear end thereof, and this recess extends axially beyond the rear end of the key so that the key protrudes slightly into the recess. A catch 116 is supported within the recess for pivotal movement about a pin. The catch includes a shoulder that is retained in the recess by the protruding tip of the key so that the range of pivotal movement of the catch is restricted. Normally, gravity maintains the catch in a first, lowered position, as shown in FIG. 2, wherein the catch protrudes radially beyond the key, and engages the rear end plate of the sleeve. A fluid-actuated cylinder assembly 118 is attached to the front surface of the mounting plate in alignment with the catch so that when the rod is fully retracted, and the cylinder assembly is actuated, as shown in FIG. 8, a piston of the assembly engages the catch and moves it to a second, raised position, wherein the catch is retracted into the recess.

Figure 7:
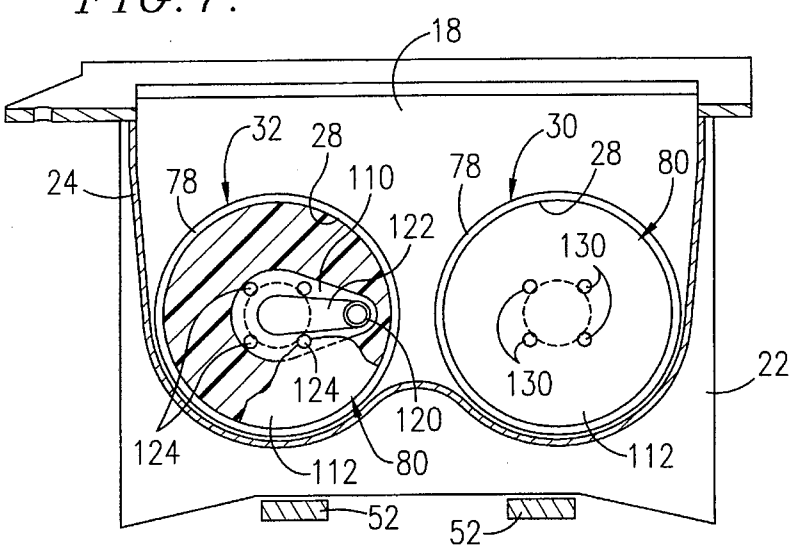
FIG. 7 is a sectional view taken along line 7—7 of FIG. 2.

As shown in FIG. 10, the head of the piston is secured to the rod 108, and includes an eccentric shape protruding radially from the rod along the entire circumferential edge of the head. The head is formed of a solid piece of material, and includes an axially extending hole spaced radially from the rod for connection to a vacuum tube 120. As shown in FIG. 7, the front surface of the head includes a shallow, elongated, radially extending recess 122 that provides communication between the vacuum tube 120 and the central region of the front surface. In addition, four axially extending pins 124 protrude from the front surface of the head.

As shown in FIG. 12, the piston face 112 is preferably formed of a thermoplastic resin or the like, and includes a recess 126 formed in the rear surface thereof sized for receipt of the head 110. The recess 126 is formed of a depth greater than the axial thickness of the head so that the head and face are able to shift axially relative to one another. A seal is provided within the recess for sealing the space around the circumferential edge of the head, and an attachment means 128 is provided for attaching the face to the head and for permitting removal of the face from the head to permit cleaning of the face, head and rod of the piston.

The front surface of the face is illustrated on the right-hand assembly 30 in FIG. 7, and defines the product engaging surface of the piston. The front surface includes four holes 130 communicating with the recess 126 and aligned with the pins 124. In addition, as shown in FIG. 11, a seal is provided around the circumferential edge of the face for sealing the space between the face and the sleeve.

The attachment means is shown in FIG. 6, and includes a pair of opposed latches 132 supported on the rear surface of the face and movable between a locking position overlying a portion of the recess 126 and an unlocking position radially spaced from the recess. Turning to FIG. 10, the latches are guided for movement between the locking and unlocking positions by ways defined by a plurality of upstanding guide elements 134, and are retained on the face by a retainer 136 that covers the guide elements. A detent 138 is provided in the rear surface of the face for each latch, and functions to retain the latch in the locking position when the pistons are being reciprocated in use of the dual-piston pump apparatus and for releasing the latch for movement to the unlocking position during clean-up of the apparatus.

Preferably, as shown in FIG. 11, each latch includes a tab 140 that protrudes from the rear surface of the face for permitting manual actuation of the latches. Thus, movement of the latches to the unlocking position is achieved by manually depressing the detents and physically sliding the latches to the unlocked position.

Alternately, the tabs may be constructed so that they protrude radially into close proximity with the sleeve when the latches are in the locking position such that the sleeve prevents the latches from being moved to the unlocked position. By providing this construction, it is not possible for the face to be removed from the head as long as the face is positioned within the sleeve. In order to remove the face, the piston must be extended beyond the end of the sleeve so that the latches may be moved to the unlocking position.

The piston drive means is shown in FIG. 4, and includes a single fluid actuated cylinder assembly 142 that is secured to the mounting plate 50 and oriented at the same angle to the frame as the cylinder assemblies. The cylinder assembly 142 includes a rod 144 that is extended and retracted upon actuation of the assembly for reciprocating the piston 80 back and forth within the pump chamber independent of the sleeve 78. The rod 144 is connected to the end of the piston rod 108 so that the piston rod is coaxial with the cylinder rod for movement therewith.

Preferably, the cylinder assembly 142 is provided with a linear displacement transducer for detecting the position of the piston during operation of the cylinder assembly. This transducer is used by the control means for coordinating operation of the pistons and sleeves during a pumping operation.

The vacuum assembly is illustrated in FIG. 2, and is provided on the apparatus for de-aerating the comestible product in the pump chamber. The assembly is adapted for use with a remote vacuum pump, and includes a line 146 extending between the apparatus and the vacuum pump. A tank 148 is provided in the line, and presents an air passage 150 through which air is drawn from a pair of branch lines 152,154, as shown in FIG. 3. The passage 150 is normally open, but may be closed by a float 156 when liquid in the tank reaches a level sufficient to lift the float into blocking relation to the passage.

As shown in FIG. 4, the branch lines 152,154 each include an outer tube 158 secured between the tank and the mounting plate 50, and the tube 120 connected at one end to the piston head, and having a second end received in the outer tube 158. The outer tube presents an inner diameter slightly larger than the outer diameter of the inner tube 120 so that the inner tube is telescopically received therein. This construction permits extension and retraction of the piston and of the inner tube, while maintaining a vacuum pressure within the tubes.

As shown in FIG. 14, the forward end of the inner tube 120 is brought into communication with the pump chamber when the sleeve 78 is extended relative to the piston at the beginning of a pump cycle. As the sleeve is extended, the face 112 is pulled with the sleeve such that the face slides relative to the head, causing the pins 124 to be pulled from the holes 130 in the face so that air may be drawn from within the pump chamber through the recess 126 in the face and along the tubes 158, 120 to the vacuum pump, as indicated by the arrows 162. As the piston is extended relative to the sleeve, the face is brought back into contact with the head so that the pins 124 engage the holes 130 in the face to cut off the vacuum pressure, as shown in FIG. 15.

Returning to FIG. 2, during a material handling operation, a comestible product or the like is mixed in the hopper assembly 12 and conveyed to the pump chamber of the apparatus by the auger 74 which rotates within the transfer housing 70. The material is continuously mixed in the hopper, and is intermittently moved by the auger into the pump chamber as the sleeves 78 and pistons 80 of the assemblies 30, 32 are retracted after each pumping motion.

Pumping of the material is initiated by movement of one of the sleeves 78 toward the extended position, as shown in FIG. 14. As this movement is carried out, the face of the piston is drawn away from the head, allowing a vacuum to be drawn through the piston face to de-aerate the material in the chamber. The sleeve 78 is moved completely against the front wall of the pump chamber, as shown in FIG. 3, and seal rings 164 are provided at each opening in the front wall against which the sleeves bear in the extended position.

Following extension of the sleeve 78 of the assembly 30, the piston 80 of the same assembly is extended the full length of the pump chamber so that material within the sleeve is forced through the outlet passage 40, the valve rotor 48 and the outlet 46 for delivery from the apparatus. As the piston moves within the sleeve, the face 112 and head 110 of the piston again close to shut off vacuum to the chamber. Once motion of the piston is complete, as shown in FIG. 15, the rotor 48 is turned from the position shown in FIG. 3 to the position shown in FIG. 4, and the pumping sequence is repeated by the other piston pump assembly 32, with the sleeve moving first to the extended position, and with the piston following to pump material from the apparatus through outlet passage 42.

After the sleeves and pistons of each assembly are extended, and the other assembly is actuated for pumping movement, the extended sleeve and piston are retracted together, as shown in FIG. 16, to the position illustrated in FIG. 13, wherein the end of the sleeve and the product engaging surface of the face 112 are flush with the rear wall 22 of the pump chamber. Thus, each stroke of the assembly covers the full length of the pump chamber.

As shown in FIG. 2, the catch 116 on the piston rod is positioned to normally engage the end plate 82 of the sleeve whenever the product engaging surface of the piston is aligned with the front end of the sleeve. The catch 116 serves two functions: first, to prevent the piston 80 from being extended relative to the sleeve 78 during pumping such that material is not able to be blown back into the sleeve behind the piston face; and second, to prevent the sleeve from being withdrawn from the openings 28 in the rear wall of the pump chamber such that material is not able to leak from the chamber through the openings.

During clean-up of the apparatus, the cylinder assembly 118 is actuated to release the catch 116, as shown in FIG. 8, and the sleeve 78 of each piston pump assembly is withdrawn from the chamber. After the sleeves exit the chamber, the piston 80 of each assembly is extended to a position within the pump chamber, as shown in FIG. 9. In this position of the piston pump assemblies, the piston faces may be removed and cleaned, and the pump chamber, sleeve and piston are easily accessible within the apparatus for cleaning. The collars 34 provided on the back of the rear wall at each opening are also uncovered for cleaning when the sleeve is withdrawn from the chamber.

Figure 17:
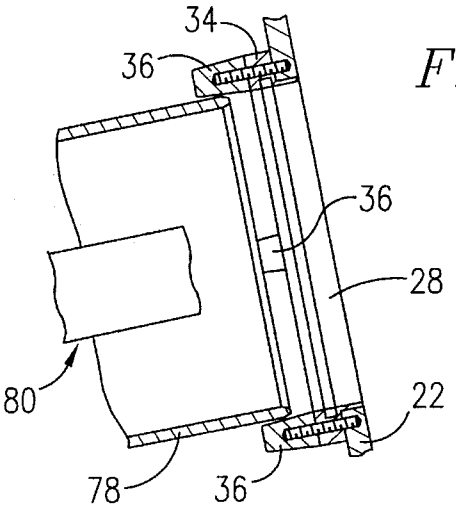
FIG. 17 is a sectional view of a rear end wall of a pump chamber of the apparatus, illustrating guide elements that are used to guide the sleeves into openings formed in the rear wall.

Once cleaning is complete, the piston faces 112 are attached to the piston heads, the pistons are retracted toward the sleeves, and the sleeves are extended back into the openings of the rear wall of the chamber. As shown in FIG. 17, the plurality of guide elements 36 guide the sleeves into the openings after a clean-up operation. As the piston and sleeve of each assembly are brought back together, the catch 116 passes through the end wall of the sleeve and drops by gravity to the lower position. Thereafter, the assemblies are ready for another pumping operation.

By providing a construction in accordance with the preferred embodiment, numerous advantages are achieved. For example, very few parts are required which must be removed from the apparatus and independently handled during cleaning. Thus, the risk of losing parts is substantially reduced relative to conventional constructions.

In addition, by angling the pump chamber and piston pump assemblies relative to horizontal, drainage of cleaning fluid is assured. The angle chosen must be great enough to protect against the formation of low spots in which fluid may settle during cleaning, but should not be so great as to permit material to rest on the piston face during repeated pumping strokes of the assemblies. An angle of 11° to horizontal has been found most advantageous. However, angles ranging from greater than 0° to up to 60° and beyond may be feasible, depending upon the material to be pumped. It is noted, though, that as the angle approaches vertical or 90°, that low spots may again develop on surfaces normal to the direction of reciprocating movement of the sleeves and pistons.

A second embodiment of the piston is illustrated in FIGS. 18–21, and includes an elongated cylindrical rod 108' presenting opposed first and second ends, a head 110' secured to the first end of the rod and including a circumferential edge protruding radially beyond the rod, and a face 112' presenting opposed front and rear surfaces.

Figure 19:
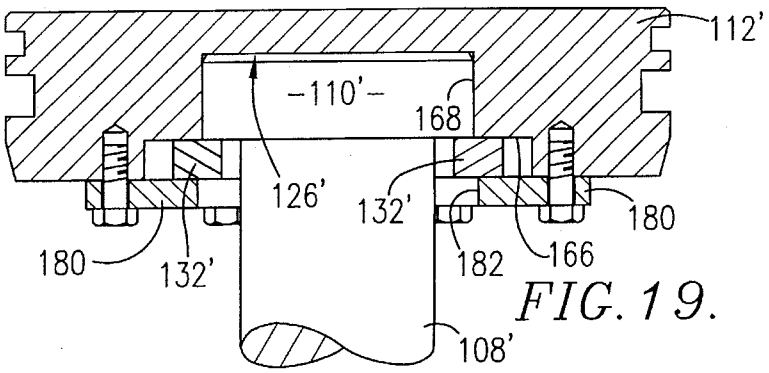
FIG. 19 is a sectional view taken through line 19—19 of FIG. 18.

The rod is preferably formed of a solid, cylindrical piece of material, and is of the same construction as the rod described above and shown in the embodiment of FIGS. 1–17. As shown in FIG. 19, the head of the piston is secured to the rod 108', and includes a circular shape coaxial with the rod so that the head protrudes radially from the rod along the entire circumferential edge of the head. The head is formed of a solid piece of material, but does not include any means for connecting to a vacuum source as is the case with the piston construction described above.

The piston face 112' is preferably formed of a thermoplastic resin or the like, and includes a recess 126' formed in the rear surface thereof sized for receipt of the head 110'. The recess 126' is stepped to present an outer, large diameter recess 166 and an inner, small diameter recess 168. The inner recess is circular, and is formed of a diameter adapted to receive the head 110' of the piston, and is preferably of a depth equal to the axial thickness of the head.

Figure 21:
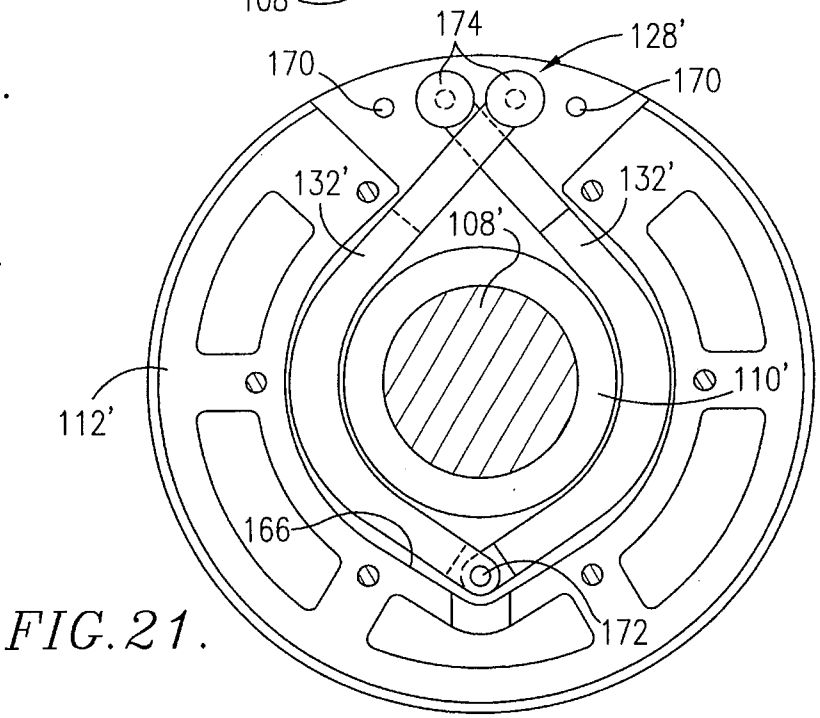
FIG. 21 is a sectional view similar to FIG. 18, illustrating the piston face with a rear cover plate of the face removed.

The outer recess 166 is illustrated in FIG. 21, and includes a generally circular section surrounding the inner recess, and a tail section extending radially from the circular section to the circumferential edge of the face. Four axially extending holes 170 are formed in the rear surface of the face within the tail section of the outer recess, and are aligned circumferentially with one another.

An attachment means 128' is provided for attaching the face 112' to the head 110' and for permitting removal of the face from the head to permit cleaning of the face, head and rod of the piston in the same manner as with the piston of the first described embodiment above. The front surface of the piston face defines the product engaging surface of the piston, and is free of any holes. Thus, the piston is not adapted to draw a vacuum through the piston face during operation of the apparatus, but rather is designed for use in an apparatus employing a vacuum hopper assembly of the type described above with reference to FIGS. 1–17.

It is noted that although the embodiment of the piston illustrated in FIGS. 1–17 is described as including both a vacuum hopper assembly and a vacuum piston construction, that these two features will not typically be provided on the same machine. Rather, a vacuum hopper assembly is normally employed with a piston construction of the type shown in FIGS. 18–21, and the piston construction illustrated in FIGS. 1–17 is typically employed with a non-vacuumized hopper assembly.

Figure 18:
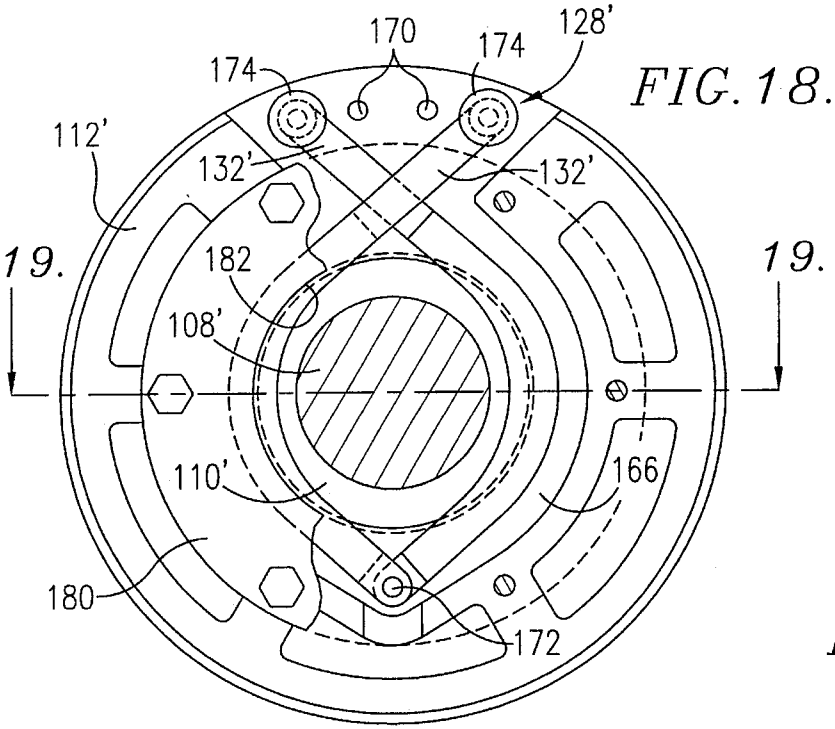
FIG. 18 is a sectional view through the piston rod of an alternate piston construction of the preferred embodiment.

The attachment means 128' of the second preferred piston construction is shown in FIG. 18, and includes a pair of opposed latches 132' supported on the rear surface of the face within the outer recess 166 and movable between a locking position, as shown in FIG. 18, in which the latches overly portions of the inner recess 168 and an unlocking position radially spaced from the inner recess. The latches are guided for pivotal movement about a pivot pin 172 located within the outer recess on one side of the inner recess.

Each latch is generally C-shaped, and includes opposed ends which are stepped to permit the latches to overlap one another when positioned on the face, and to enable the latches to be pivoted about the pin 172 toward and away from one another between a latched position as shown in FIG. 18 and an unlatched position, shown in FIG. 21.

Figure 20:
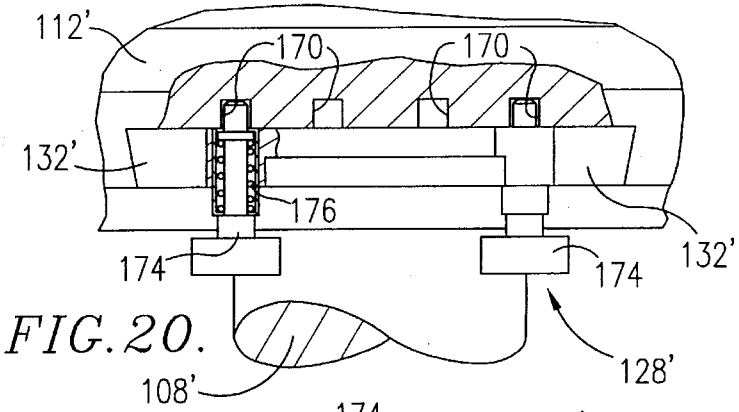
FIG. 20 is a fragmentary top plan view of the alternate piston construction, taken partly in section to show the construction of an attachment assembly.

A locking pin 174 is provided on each latch at the end opposite the pivot pin, and the locking pin is supported on the latch for axial movement in a direction transverse to the length of the latch. As shown in FIG. 20, each latch defines a pin receiving sleeve within which the pin 174 is retained, and a compression spring 176 is provided within the sleeve for biasing the pin toward the face of the piston. Each pin includes a protruding end that is sized for receipt in any of the holes 170 and the latches may be locked in either the latched or unlatched position by moving the latches to the desired position so that the pins engage the holes.

An annular rear cover plate 180 is attached to the rear of the piston face, as shown in FIG. 19, and supports the piston face on the rod when the latches are in the latched position shown in FIG. 19. The cover plate includes a central opening 182 sized slightly larger than the diameter of the head so that when the latches are moved to the unlatched position, the face may be removed from the piston rod for cleaning or the like. Thus, it is not necessary to remove the cover plate in order to remove the face.

As shown in FIG. 18, the locking pins 174 are provided with heads by which they may be gripped in order to permit latching and unlatching of the head. However, because the piston is positioned within a sleeve during operation of the pump apparatus, it is not possible to remove the face of the piston unless the piston has been extended beyond the sleeve to permit access to the pins at the rear of the face.

Although the present invention has been described with reference to the preferred embodiment illustrated in the attached drawing figures, it is noted that substitutions may be made and equivalents employed herein without departing from the scope of the invention as recited in the claims.

What is claimed is:

1. A dual-piston pump apparatus comprising:

a frame defining a pump chamber having a common zone for receiving therein material to be pumped by both of said dual pistons, said chamber including structure defining an inlet and an outlet;

a pair of side-by-side pistons each supported on the frame for reciprocating movement within the pump chamber along a line that is angled relative to the horizontal by an angle of less than about 45° between a retracted position withdrawn from the outlet and an extended position adjacent the outlet, each piston being movable, through said common material-receiving zone between the retracted and extended positions thereof and presenting a piston face; and a piston moving means for reciprocating the pistons between the retracted and extended positions thereof and through said common material-receiving zone.

2. An apparatus as recited in claim 1, wherein the line along which each piston is reciprocated is angled relative to horizontal by an angle of about 11°.

3. An apparatus as recited in claim 1, wherein the pump chamber is formed by a front wall, a rear wall spaced from the front wall in the direction of movement of the pistons, and a side wall extending between the front and rear walls, the side wall being angled relative to horizontal by the same angle as the line along which each piston is reciprocated.

4. An apparatus as recited in claim 3, wherein the front and rear walls each extend in a direction transverse to the line along which each piston is reciprocated.

5. An apparatus as recited in claim 1, further comprising:

a pair of side-by-side sleeves within which the pistons are supported, each sleeve presenting a free end and being supported on the frame for reciprocating movement within the pump chamber along the same line along which each piston is supported; and a sleeve moving means for reciprocating the sleeves between the retracted and extended positions.

6. An apparatus as recited in claim 1, wherein the face of each piston is disposed in a plane generally transverse to the direction of movement of the piston.

7. In a dual-piston pump apparatus, the combination comprising:

a pair of side-by-side pistons each supported for reciprocating pumping movement between a retracted position and an extended position, and including an elongated cylindrical rod presenting opposed first and second ends, a head secured to the first end of the rod and including a circumferential edge protruding radially beyond the rod, and a face presenting opposed front and rear surfaces, the face having a recess formed in the rear surface sized for receipt of the head;

an attachment means for attaching the face of each piston to the head of the piston and for permitting removal of the face from the head to permit cleaning of the face, head and rod of each piston, the attachment means including a latch supported on the rear surface of each face and movable between a locking position overlying a portion of the recess and an unlocking position radially spaced from the recess, and a retaining means for retaining the latch in the locking position when the pistons are being reciprocated in use of the dual-piston pump apparatus and for releasing the latch for movement to the unlocking position during clean-up of the apparatus.

8. A combination as recited in claim 7, wherein the attachment means includes a pair of latches on each face which radially oppose one another so that each face is attached to one of the heads on both sides of the corresponding rod.

9. A combination as recited in claim 7, wherein each latch includes a tab protruding outward from the rear surface of the corresponding face, the tab permitting the latch to be manually gripped and moved between the locked and unlocked positions.

10. A combination as recited in claim 7, wherein the retaining means includes a detent associated with each latch, the detents being movable between a blocking position in which the latches are held in the locked position, and a releasing position in which the latches are freed for movement to the unlocked position.

11. A combination as recited in claim 7, further comprising a support means for supporting each latch on one of the faces for movement between the locked and unlocked positions while preventing removal of the latch from the face.

12. A dual-piston pump apparatus comprising:

a frame including a pump chamber having a front wall defining an outlet and a rear wall opposing the front wall;

a pair of side-by-side sleeves each presenting a free end and being supported on the frame for reciprocating movement within the pump chamber between a retracted position in which the end of the sleeve is disposed adjacent the rear wall of the chamber and an extended position in which the end is disposed adjacent the outlet;

a sleeve moving means for reciprocating the sleeves between the retracted and extended positions;

a pair of side-by-side pistons each presenting a piston face and being supported within one of the sleeves for reciprocating movement between a retracted position in which the piston face is disposed adjacent the rear wall of the chamber and an extended position in which the piston face is disposed adjacent the outlet;

a piston moving means for reciprocating the pistons between the retracted and extended positions;

a stop means for physically preventing the ends of the sleeves from being withdrawn from the chamber beyond the rear end wall and the pistons from being extended beyond the ends of the sleeves; and a release means for releasing the stop means to permit the sleeves to be withdrawn from the chamber and the pistons to be extended beyond the ends of the sleeves so that the chamber, sleeves and pistons are accessible for cleaning.

13. An apparatus as recited in claim 12, wherein the stop means includes a catch supported on each piston and movable between a first position in which the catch protrudes into the path of movement of the corresponding sleeve and a second position in which the catch is removed from the path of movement of the corresponding sleeve, the catches in the first position preventing the pistons from being extended beyond the ends of the sleeves.

14. An apparatus as recited in claim 13, wherein the release means moves the catches to the second position so that the pistons may be extended beyond the ends of the sleeves and the sleeves may be withdrawn from the chamber.

15. An apparatus as recited in claim 14, wherein the release means includes an actuator associated with each catch for moving the catch between the first and second positions.

16. An apparatus as recited in claim 13, wherein each piston includes an elongated rod having an axially extending key and a recess formed adjacent an end of the key, each catch being supported for pivotal movement within the recess of one of the rods, the range of movement of the catches being restricted by the keys.

17. A method of cleaning a dual-piston pump apparatus comprising the steps of:

moving a catch from a first position in which the catch prevents the end of a reciprocative sleeve of the apparatus from being withdrawn from a pump chamber of the apparatus and a reciprocative piston of the apparatus from being extended into the chamber beyond the sleeve, to a second position in which the end of the sleeve is free to be withdrawn from the pump chamber and the piston is free to be extended beyond the sleeve;

retracting the sleeve to a position withdrawn from the pump chamber to expose the hole in the chamber from which the sleeve is removed;

extending the piston into the chamber beyond the sleeve to expose a face and head of the piston within the chamber; and cleaning all exposed surfaces of the apparatus.

18. A method as recited in claim 17, further comprising the step of removing the face of the piston from the head before cleaning all exposed surfaces of the apparatus.

19. A dual-piston pump apparatus comprising:

a frame defining a pump chamber having an inlet and an outlet;

a pair of side-by-side pistons each supported on the frame for reciprocating movement within the pump chamber along a line that is angled relative to the horizontal by an angle of less than about 45° between a retracted position withdrawn from the outlet and an extended position adjacent the outlet, each piston presenting a piston face;

a piston moving means for reciprocating the pistons between the retracted and extended positions;

a pair of side-by-side sleeves within which the pistons are supported, each sleeve presenting a free end and being supported on the frame for reciprocating movement within the pump chamber along the same line along which each piston is supported; and a sleeve moving means for reciprocating the sleeves between the retracted and extended positions.

20. A dual-piston pump apparatus comprising:

a frame defining a pump chamber having an inlet and an outlet;

a pair of side-by-side pistons each supported on the frame for reciprocating movement within the pump chamber along a line that is angled relative to the horizontal by an angle of about 11° between a retracted position withdrawn from the outlet and an extended position adjacent the outlet, each piston presenting a piston face; and a piston moving means for reciprocating the pistons between the retracted and extended positions.

* * * * *